US006576025B2

(12) United States Patent
Lapierre

(10) Patent No.: US 6,576,025 B2
(45) Date of Patent: Jun. 10, 2003

(54) FABRIC BLENDS OF ARAMID FIBERS AND FLAME RESISTANT CELLULOSIC FIBERS

(75) Inventor: Francois Lapierre, Brossard (CA)

(73) Assignee: Difco Performance Fabrics, Inc., North Charleston, SC (US)

( * ) Notice: Subject to any disclaimer, the term of this patent is extended or adjusted under 35 U.S.C. 154(b) by 123 days.

(21) Appl. No.: 09/775,251

(22) Filed: Feb. 1, 2001

(65) Prior Publication Data

US 2002/0142686 A1 Oct. 3, 2002

(51) Int. Cl.[7] ..... D06P 3/87; D06P 1/651

(52) U.S. Cl. ..... 8/485; 8/529; 8/925; 8/531; 8/582

(58) Field of Search ..... 8/925, 529, 485, 8/531, 582

(56) References Cited

U.S. PATENT DOCUMENTS 5,174,790 A * 12/1992 Riggins et al.
5,215,545 A 6/1993 Cates et al.
6,132,476 A 10/2000 Lunsford et al.

FOREIGN PATENT DOCUMENTS

JP 50-90778 7/1975
JP 58-87376 5/1983

* cited by examiner

*Primary Examiner*—Margaret Einsmann
(74) *Attorney, Agent, or Firm*—Robert H. Hammer, III

(57) ABSTRACT

The instant invention is directed to dyed fabric blends of aramid fibers and flame resistant (FR) cellulosic fibers, which retains a substantial amount of its strength and durability after dyeing. The dyeing process comprises the steps of: providing a fabric comprising a blend of aramid fibers and cellulosic fibers, dyeing the cellulosic fibers of the fabric, and dyeing the aramid fibers of the fabric. Dyeing of the aramid fibers being preformed with low agitation, an aryl ester carrier, and, preferably, at a temperature between 100–110° C.

8 Claims, No Drawings

FABRIC BLENDS OF ARAMID FIBERS AND FLAME RESISTANT CELLULOSIC FIBERS

FIELD OF THE INVENTION

The instant invention is directed to a dyed fabric blend of aramid fibers and flame resistant (FR) cellulosic fibers.

BACKGROUND OF THE INVENTION

Fabric blends of aramid fibers and flame resistant (FR) cellulosic fibers are known. See: Japanese Kokais 50-90778 and 58-87376, and U.S. Pat. Nos. 5,215,545 and 6,132,476. These fabric blends are popular today for use in protective garments. These blends are more comfortable than prior fabrics made of aramid fibers alone. Comfort is an important factor in the commercialization of such garments. Other important factors include, but are not limited to, availability of the fabric in various colors, cost of the fabric, durability of the fabric, and ability of the fabric to protect the wearer from specific hazard, such as fire, flame, or the like.

The blends of fibers give rise to greater comfort, but the blends are difficult to dye because aramid fibers and FR cellulosic fibers are so different, for example, these fibers require different dyes, processing aids, and dye process conditions. These fibers were so different, in fact, that until recently it was believed that such blends could not be dyed commercially in a blended form because the conditions (e.g., dye bath temperature for aramid dyeing) necessary to dye the aramid fibers would destroy the FR treatment on the cellulosic fiber. Therefore, aramid fiber producers offered "solution" dyed aramid fibers. Solution dyed aramid fibers address the dyeing problem, but such fibers are expensive and limited in choice of color. In Japanese Kokai 50-90778, a fabric blend of aramid fibers and flame retardant rayon fibers is dyed in a bath containing reactive dyes and an assistant (dimethyl phosphate carboxy methylol amide) at a temperature less than 100° C. In Japanese Kokai 58-87376, a fabric blend of aramid fibers and rayon fibers is dyed in a bath containing a basic dye and a carrier (i.e., acetophenones or paraphenyl phenol) at a temperature between 100° C. and 120° C. In U.S. Pat. No. 5,215,545, there is disclosed a two-step process for printing on a fabric blend of aramid fibers and FR cellulosic fibers. The blend is pretreated with a dye assistant, such as N-octyl-pyrrolidone (NOP), prior to printing and/or FR treatment. In U.S. Pat. No. 6,132,476, there is disclosed a two-step process for dyeing a fabric blend of aramids and FR rayon (viscose). First, the FR rayon fibers of the blend are dyed, in a conventional manner, and, thereafter, the aramid fibers of the blend are dyed in a "jet-dyer" at a temperature between 70–100° C. using a dye assistant, e.g., N-octyl-pyrrolidone (NOP). While the latter process does provide a process for dyeing the blends, the process weakens the blend which reduces its strength and durability.

Accordingly, there is a need to provide dyed fabric blends of aramid fibers and FR cellulosic fibers and processes for producing them.

SUMMARY OF THE INVENTION

The instant invention is directed to dyed fabric blends of aramid fibers and flame resistant (FR) cellulosic fibers, which retains a substantial amount of its strength and durability after dyeing. The dyeing process comprises the steps of: providing a fabric comprising a blend of aramid fibers and cellulosic fibers, dyeing the cellulosic fibers of the fabric, and dyeing the aramid fibers of the fabric. Dyeing of the aramid fibers being preformed with low agitation, an aryl ester carrier, and, preferably, at a temperature between 100–110° C.

DETAILED DESCRIPTION OF THE INVENTION

The present invention is directed to a dyed fabric blend of aramid fibers and FR cellulosic fibers, which retains a substantial amount of its strength and durability after dyeing, and a process for dyeing that fabric. To illustrate this statement, reference is made to Table 1 where a blended fabric dyed according to the instant invention is compared to one dyed according to the procedure set out U.S. Pat. No. 6,132,476.

TABLE I

| Property | Invention | Prior Art (U.S. Pat. No. 6,132,476) |
|---|---|---|
| Blend | 65% Nomex<br>35% Rayon FR | 65% Nomex<br>35% Rayon FR |
| Weight | 4.6 osy | 4.6 osy |
| Weave | Plain | Plain |
| Tensile (ASTM D5034-1990) | 114 × 79 lb. | 106 × 57 lb. |
| Tear (ASTM D5587) | 20.3 × 10.6 lb. | 18.5 × 9.4 lb. |
| Abrasion (ASTM D-3884) | 290 cycles | 225 cycles |
| Thermal shrinkage (oven) (NFPA 1975–1999) | 1.2% × 0.8% | 4.5% × 3.0% |

While not wishing to be bound to this theory, it is believed that, in the low temperature, prior art process, the aramid fibers are insufficiently crystallized and that higher temperatures facilitate crystallization.

Fabric blends refer to blends of aramid fibers and FR cellulosic fibers. Blends of these fibers may range from 20–80% aramid fibers in combination with about 80–20% FR cellulosic fibers. Blends having 40–65% aramid are preferred. Aramid fibers refer to both meta-aramid fibers and para-aramid fibers. Meta-aramids are the preferred aramid fiber. FR cellulosic fibers refer to rayon (viscose), acetate, tri-acetate, and lyocell which are pretreated with flame retardants. Rayon is the preferred cellulosic fiber. The aramid fibers, cellulosic fibers, and FR treatments, referred to herein, are conventional.

In the dyeing process, the aramid fibers and cellulosic fibers of the blend are dyed in separate steps. Dyeing refers to a single shade of color and the dye penetrating into both fibers. For example, the fabric is subjected to a dye bath for the aramid fibers and then to a dye bath for cellulosic fibers. The procedures of this process are set out below.

In the present invention, the blends are dyed in low agitation dyeing processes versus high agitation dyeing processes. While not wishing to be bound to this theory, it is believed that agitation causes the loss of FR treatment from the blend in addition to or instead of the dye bath temperature. Accordingly, if a low agitation process is used, then dye bath temperatures may be increased which, in turn, is less severe or more beneficial to the blend and allows the blend to retain greater strength and durability. High agitation processes include "jet dyeing" in which the dye liquor is impinged on the fabric moving through a venturi jet system. Low agitation processes include, for example, beam (package) dyeing, jig dyeing, and beck dyeing.

With regard to dyeing the FR cellulosic fibers of the blend, they are dyed in a conventional manner. The aqueous dye bath must include, for example, a dye stuff and a surfactant (wetting agent). The dye stuff is any conventionally used with cellulosic fibers. The preferred dye stuffs include vat dyes and reactive dyes. Other additives may also be included in the bath, for example, carriers, dispersing aids, surfactants, oil and water repellents, crease resistant and auxilory finishes, biologically protective finishes, and flame retardants. The liquor ratio is conventional; preferably, it is 1:15. Preferably, the blend is maintained in the bath at a temperature (preferably about 60° C.) for a specific time (preferably about 30 minutes). Thereafter, the fabric is cooled and rinsed in a known manner.

With regard to dyeing the aramid fibers of the blend, they are preferably dyed in the manner set out below. The aqueous dye bath should include, for example, a dye stuff, a dispersing agent, a surfactant (e.g., wicking agent), and a carrier. The dye stuff is any conventionally used with aramid fibers. The preferred dye stuff includes cationic dyes or basic dyes. The dispersing agent is any conventionally used with the chosen dye stuff. The surfactant is chosen to ensure that the dye stuff is wetted on to the fibers. The carrier is chosen to facilitate dye penetration into the aramid fiber. The carrier is preferably an aryl ester, and most preferably 1-phenoxy-propanol. Other additives may also be included in the bath, for example, photo protective agents, antioxidants, and antistatic agents. The liquor ratio is conventional; preferably, it is 1:15. Preferably, the blend is maintained in the bath at a temperature (preferably between 100° C. and 110° C.) for a specific time (preferably about 45 minutes). Thereafter, the fabric is cooled and rinsed in a known manner.

After all dyeing has been completed, the fabric then can be finished in the conventional manner. The finishing process can include the application of wicking agents, water repellents, stiffening agents, softeners, and the like.

EXAMPLE

An aramid/FR rayon blend was dyed according to the following process:

The blend consisted of a 65% aramid (Nomex® fiber)—35% FR rayon (Lenzing). Dyeing was conducted in a beam dyeing apparatus. The dye bath (liquor ratio 1:15) for the FR rayon comprised a wetting agent, salt, soda ash-alkali, and a reactive dye stuff. The fabric was held in the dye bath for 30 minutes at 60° C. Thereafter, the fabric was rinsed. The dye bath (liquor ratio 1:15) for the aramid comprised a dispersing agent, a carrier (1-phenoxy-propanol), sodium nitrate, a wicking agent, and a cationic (or basic) dye stuff. The fabric was held in the dye bath for 45 minutes at 110° C. Thereafter, the fabric was washed and dried. During the entire dyeing process, the fabric was static and not agitated.

The present invention may be embodied in other specific forms without departing from the spirit or essential attributes thereof and, accordingly, reference should be made to the appended claims, rather than to the foregoing specifications, as indicating the scope of the invention.

What is claimed is:

1. A process for dyeing fabric blends of aramid fibers and cellulosic fibers comprising the steps of:

providing a fabric comprising a blend of aramid fibers and cellulosic fibers, dyeing the cellulosic fibers of the fabric in a dye bath for cellulosic fibers, and dyeing the aramid fibers of the fabric in a dye bath for aramid fibers, said dyeing of the aramid fibers being performed with a low agitation process being selected from the group consisting of beam dyeing, jig dyeing, and beck dyeing, wherein the dye bath for the cellulosic fibers being different from the dye bath for the aramid fibers and the dyeing steps being performed sequentially.

2. The process according to claim 1 wherein dyeing of aramid fibers being performed at a temperature ranging between 100–110° C.

3. The process according to claim 1 wherein dyeing of aramid fibers being performed with a carrier selected from the group consisting of aryl esters.

4. The process according to claim 3 wherein said aryl ester is 1-phenoxy-propanol.

5. A process for dyeing fabric blends of aramid fibers and cellulosic fibers comprised in the steps of:

providing a fabric comprising a blend of aramid fibers and cellulosic fibers, dyeing the cellulosic fibers of the fabric in a dye bath for cellulosic fibers, and dyeing the aramid fibers of the fabric in a dye bath for aramid fibers, said dyeing of the aramid fibers being performed with a low agitation process being selected from the group consisting of beam dyeing, jig dyeing, and beck dyeing, at a temperature ranging between 100–110° C. and with a carrier selected from the group consisting of aryl esters, wherein the dye bath for the cellulosic fibers being different from the dye bath for the aramid fibers and the dyeing steps being performed sequentially.

6. The process according to claim 5 wherein said aryl ester is 1-phenoxy-propanol.

7. A process for dyeing an aramid fabric comprising the steps of:

providing an aramid fabric dyeing said fabric by subjecting said fabric to low agitation process, said process being selected from the group consisting of beam dyeing, jig dyeing, and beck dyeing, at a temperature ranging from 100° C. to 110° C. in a dye bath including a dye stuff, and an aryl ester carrier.

8. The process according to claim 7 wherein said aryl ester is 1-phenoxy-propanol.

* * * * *